US005518589A

United States Patent [19]

Matsuura et al.

[11] Patent Number: 5,518,589

[45] Date of Patent: May 21, 1996

[54] METHOD OF PRODUCING SUPPORT FOR PLANOGRAPHIC PRINTING PLATE

[75] Inventors: Atsushi Matsuura; Akio Uesugi, both of Haibara, Japan

[73] Assignee: Fuji Photo Film Co., Ltd., Kanagawa, Japan

[21] Appl. No.: 298,673

[22] Filed: Aug. 31, 1994

[30] Foreign Application Priority Data

Aug. 31, 1993 [JP] Japan ..... 5-215701

[51] Int. Cl.[6] ..... C25F 3/04

[52] U.S. Cl. ..... 205/659; 205/661; 205/674; 205/685

[58] Field of Search ..... 204/129.1, 129.4, 204/129.75, 129.95

[56] References Cited

U.S. PATENT DOCUMENTS

| | | | |
|---|---|---|---|
| 4,721,552 | 1/1988 | Huang et al. | 204/129.4 X |
| 5,141,605 | 8/1992 | Nishino et al. | 204/129.4 |
| 5,186,795 | 2/1993 | Hall | 204/129.4 |

FOREIGN PATENT DOCUMENTS

| | | |
|---|---|---|
| 0268058 | 5/1988 | European Pat. Off. . |
| 0414189 | 2/1991 | European Pat. Off. . |
| 54-63902 | 5/1979 | Japan . |
| 63-104890 | 5/1988 | Japan . |
| 3132395 | 6/1991 | Japan . |
| 2118575 | 11/1983 | United Kingdom . |

OTHER PUBLICATIONS

Patent Abstracts of Japan, Abstract of JP–A–60–190392, Feb. 14, 1986.

Derwent Abstract of JP–A–54–085802 no date.

*Primary Examiner*—Donald R. Valentine
*Attorney, Agent, or Firm*—Sughrue, Mion, Zinn, Macpeak & Seas

[57] ABSTRACT

A method of producing a support for a planographic printing plate which comprises roughening a surface of an aluminum plate electrochemically, etching the surface by 0.01 to 20 g/m$^2$ with alkali, and roughening the surface electrochemically in an electrolytic solution containing hydrochloric acid and/or a water-soluble hydrochloride salt which forms hydrochloride ion or nitric acid and/or a water-soluble nitrate salt which forms nitrate ion as the principle component.

9 Claims, 3 Drawing Sheets

METHOD OF PRODUCING SUPPORT FOR PLANOGRAPHIC PRINTING PLATE

BACKGROUND OF THE INVENTION

This invention relates to a method of producing a support for a planographic printing plate, particularly comprising an aluminum plate, of which the surface is roughened, suitable for offset printing plate.

In general, aluminum plates are widely used as supports for a lithographic printing plate. The surface of the aluminum plate is usually roughened for the purpose of the improvement in adhesiveness of a photosensitive layer provided thereon and the improvement in the water retention of nonimage area (the area which receives damping water used during printing and repels oily ink, and is carried by the area wherein the surface of the support is exposed) of the lithographic printing plate produced using the same.

The roughening is called graining, and there are mechanical methods, such as ball graining, wire graining and blush graining, chemical methods and electrochemical methods.

Heretofore, aluminum plate was treated with a combination of a methanical roughening method and an electrochemical method to form a roughened surface suitable as a support for a planographic printing plate, as disclosed in Japanese Patent KOKAI Nos. 54-63902, 63-104890, 3-132395, etc.

However, in the printing plate using the support for a planographic printing plate formed by the above conventional roughing method, scumming reduction (the ability of not adhering ink onto nonimage area) and fill-in reduction (the ability of nonimage area for retaining water) cannot co-exist, and either characteristic was sacrificed, usually the fill-in reduction is insufficient.

Moreover, printing durability (the ability of not separating a photosensitive layer from a support upon printing) is also insufficient.

SUMMARY OF THE INVNENTION

An object of the invention is to provide a method of producing a support for a planographic printing plate which has resolved the above problems and which can produce the support excellent in reduced scumming and reduced fill-in and also excellent in printing durability.

The inventors have investigated in order to achieve the above object, and found that a roughened surface, which is first roughened by a mechanical method or the like followed by roughening pits of the roughened face to form fine pits about 0.05 to 0.5 μm in diameter, in effective for scumming reduction and fill-in reduction, and found a method capable of forming the small pits about 0.05 to 0.5 μm in diameter easily.

The present invention has been achieved based on the above findings, and the support for a planographic printing plate of the invention is made of an aluminum plate and characterized by comprising base pits having a diameter of about 1 to 30 μm and fine pits having a diameter of 0.05 to 0.5 μm formed on the base pits. The method of the innvention, which can produce the support, comprises roughening a surface of an aluminum plate electrochemically, etching the surface by 0.01 to 20 g/m$^2$ with alkali, and roughening the surface electrochemically in an electrolytic solution containing hydrochloric acid or nitric acid as the principal component.

Figure 1:
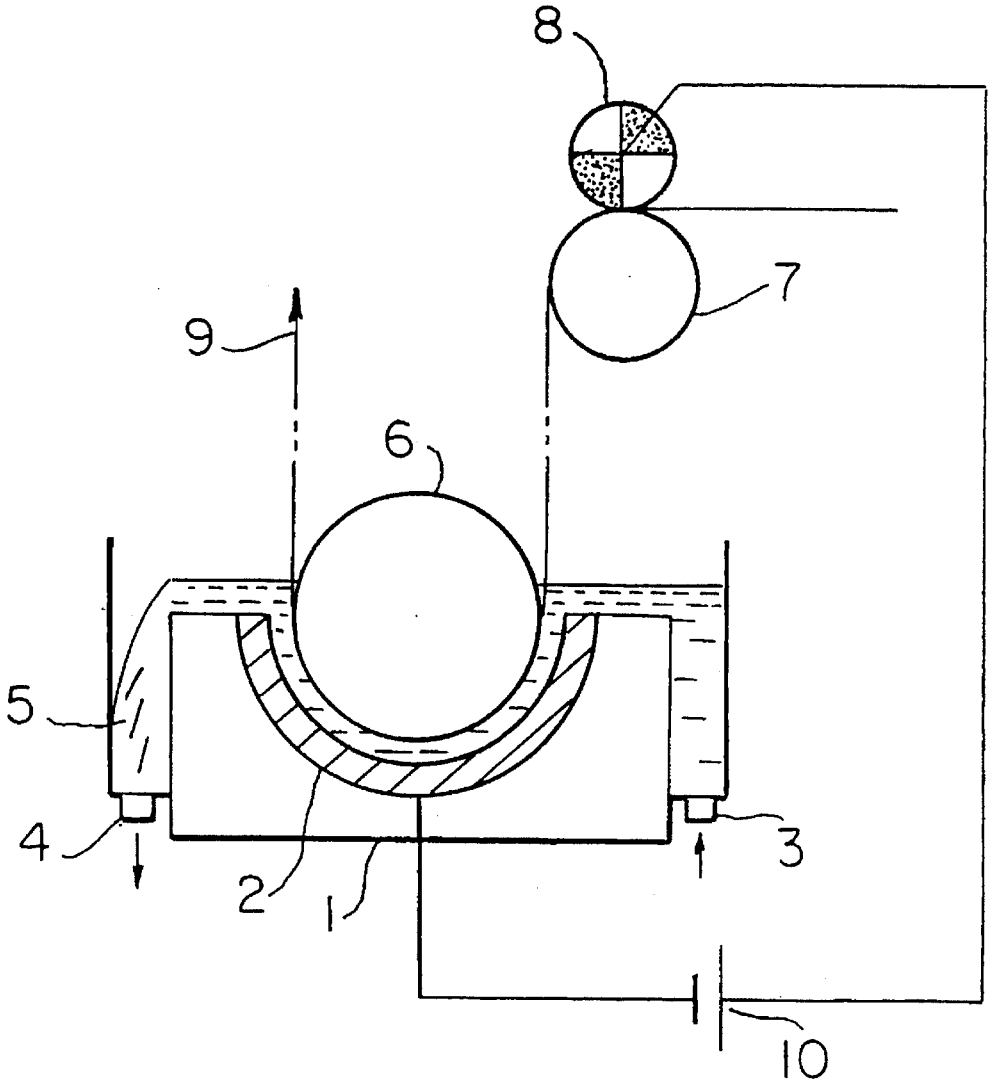
FIG. 1 is a schematic diagram illustrating an apparatus used in the method of producing a planographic printing plate of the invention.

1 . . . Electrolytic bath
2 . . . Cathode
5 . . . Electrolytic solution
6 . . . Drum roller
8 . . . Conductor roller
9 . . . Aluminum plate
10 . . . Direct current source

DETAILED DESCRIPTION OF THE INVENTION

On the support for a planographic printing plate of the invention, base pits are formed having an averaged diameter of 1 to 30 μm, preferably 3 to 15 μm. On the base pits, fine pits are formed having an average diameter of 0.05 to 0.5 μm, preferably 0.1 to 0.3 μm. When the diameter of fine pits is less than 0.05 μm, the effects exhibited by fine pits are insufficient. When the diameter exceeds 0.5 μm, the improvement in fill-in and printing is small durability.

The fine pits can be formed either by electrolyzing the aluminum plate which is made as anode with direct current in an electrolytic solution having a concentration of 15 wt. % as nitric acid or more, or by roughening electrochemically by loading alternating current between the aluminum plate and a counter electrode in an electrolytic solution of which the principal component is hydrochroric acid. In the case of direct current electrolysis, the concentration as nitric acid of less than 15 wt. % results in inferior formation of fine pits, and preferable concentration as nitric acid is 30 wt. % to 50 wt.

The above nitric acid electrolytic solution is an aqueous solution, of nitric acid and/or water-soluble nitrate salt(s) which form nitrate ion. Optional aditives are amines or the like disclosed in Japanese Patent KOKAI No. 47-38301, sulfuric acid disclosed in Japanese Patent KOKAI No. 49-57902, boric acid disclosed in Japanese Patent KOKAI No. 51-41653, phosphoric acid disclosed in DE 2250275 and the like.

A suitable temperature of the electrolytic solution is 30° to 80° C., and 40° to 60° C. is preferable.

The direct current voltage used for the direct current electrolysis includes not only continuous direct current voltage but also commercial alternating current rectified by diode, transistor, thyristor, GTO or the like, rectangular pulse direct current, and is an electric voltage wherein polarity is not changed which meets general definition of direct current.

A preferable current density is 3 to 100 A/dm$^2$, and 5 to 50 A/dm$^2$ is more preferable. A preferable quantity of electricity is 5 to 100 c/dm$^2$, and 10 to 60 c/dm$^2$ is more preferable.

When the aluminum plate is roughened electrochemically in an aqueous solution containing hydrochloric acid and/or water-soluble hydrochloride salt(s) which form hydrochloride ion as the principal component, the aluminum plate is immersed in the aqueous solution containing hydrochloric acid and/or hydrochloride(s), and AC voltage is loaded between the aluminum plate and a counter electrode. The concentration of hydrochloric acid compound can be from 1 g/l to a saturated state, and preferably 5 to 100 g/l. Preferable hydrochloric acid compounds are aluminum chloride, hydrochloric acid, sodium chloride, ammonium chloride, and magnesium chloride, which contain hydrochloric acid ion, and one or a combination of the hydrochloric acid compounds are used. Moreover, it is preferable to add an aluminum salt in an amount of 20 to 150 g/l to the above hydrochloric acid electrolytic solution. A preferable temperature of the electrolytic solution containing hydrochloric acid and/or hydrochloride is 30° to 55° C.

As the waveform of alternating current used for electrochemical roughening in the aqueous solution containing hydrochloric acid, there are sine waves as disclosed in Japanese Patent KOKOKU No. 48-28123, phase-controlled sine waves by a thyristor as disclosed in Japanese Patent KOKAI No. 55-25381, special waveforms as disclosed in Japanese Patent KOKAI No. 52-58602, and so on, and in view of equipments, rectangular wave alternating current at a duty ratio of 1:1 is preferable. Instead of alternating current, direct current can also be used as disclosed in Japanese Patent KOKAI No. 51-42605, 1-141094.

In the electrochemical roughening in the aqueous solution containing hydrochloric acid and/or hydrochloride using alternating current voltage, preferable conditions are a current density of 10 to 200 A/dm$^2$, a quantity of electricity of 1 to 1000 c/dm$^2$, more preferably 10 to 800 c/dm$^2$, and a frequency of 50 Hz or more, more preferably 60 to 500 Hz.

The aluminum plate applicable to the invention includes pure aluminum plates and aluminum alloy plates. Various aluminum alloys are usable, such as alloys of aluminum and a metal of silicon, copper, manganese, magnesium, chromium, lead, zinc, bismuth, titanium, tantalum, niolium, iron, nickel and combinations thereof.

Prior to forming fine pits, the aluiminum plate is roughened by forming base pits mechanically, chemically or electro chemically or a combination thereof.

Mechanical roughening can be carried out according to a conventional method, such as slurry brushing using a nylon brush, dry brushing using a wire brush, sandblasting, ball graining, embossing by pressing using a pressure roll, etc. As the method of forming indentations on the pressure roll for pressing, there are sandblasting, grit blasting, shot blasting, chemical etching, metal dissolving by the irradiation of easer such as maxima laser, pattern etching using a photoresist, and so on.

Chemical roughening can be carried out according to a conventional method, such as chemical etching with hydrochloric acid, alkali etching, and so on.

Electrochemical roughening in the first step can be carried out according to a conventional method, such as a method of conducting in an aqueous solution of which the principal component is hydrochloric acid and/or hydrochloride or nitric acid and/or nitrate.

The aluminum plate electrochemically roughened in the aqueous solution containing hydrochloric acid and/or hydrochloride is treated with removal of smut and/or light etching in an aqueous acid or alkali solution for the purpose of the removal of smut components generated on the surface of the aluminum plate. Examples of the acid are fluoric acid, fluorozirconic acid, phosphoric acid, sulfuric acid, hydrochloric acid, nitric acid and the like, and examples of the alkali are sodium hydroxide, potassium hydroxide, trisodium phosphate, sodium aluminate, sodium silicate, sodium carbonate and the like. Two or more aforementioned acids or alkalis can be combined. As etching degree, it is preferable to etch 0.01 to 2 g/m$^2$ of aluminum. In order to conduct etching of such a etching degree, it is suitable to select an acid or alkali concentration from 0.05 to 40%, a liquid temperature from 40° to 100° C. and a treating time from 5 to 300 seconds.

The light etching as above can be conducted also by an electrochemical treatment of the aluminum plate in an aqueous neutral salt solution by loading DC voltage wherein the aluminum plate is sendered cathod.

On the surface of the aluminum plate after the light etching, insoluble matters, i.e. smut, is generated. The smut can be removed by washing with phosphoric acid, sulfuric acid, nitric acid, chromic acid or a mixture thereof.

When the aluminum plate is roughened electrochemically in an aqueous solution of which a principal component is nitric acid and/or nitrate, the aluminum plate is immersed in the aqueous solution containing nitric acid and/or nitrate, DC voltage or AC voltage is loaded between the aluminum plate and a counter electrode. A suitable concentration of nitric acid compound is 1 g/l to its saturation, and 5 to 100 g/l is preferred. Preferable nitric acid compounds include aluminum nitrate, nitric acid, sodium nitrate, ammounium nitrate and the like, and they can be used as a single material or a combination of them. Moreover, other compounds containing nitrate ion can allso be combined. It is preferable to add and aluminum salt to the electrolytic solution in an amount of 20 to 150 g/l. A preferable temperature of the electrolytic solution containing nitric acid and/or nitrate is 30° to 55° C. As to the waveform of the alternating current, it is as mentioned in the case of hydrochloric acid and/or hydrochloride.

As the roughening conditions of the aluminum plate in the aqueous solution containing nitric acid, a current density of 10 to 200 A/dm$^2$, a quantity of electricity of 10 to 600 c/dm$^2$, more preferably 100 to 300 c/dm$^2$, are preferred. A preferable frequency of voltage or electiric potential on the aluminum plate is 160 Hz or less, and 60 to 0.1 Hz is more preferable.

The aluminum plate treated as above may be anodized in an electrolytic solution containing sulfurec acid or phosphoric acid according to a conventional manner in order to improve hydrophilic properties, water retention and printing durability. After anodizing, sealing of pores may also be conducted. Furthermore, a treatment for rendering hydrophilic may be conducted by immersing in an aqueous solution containing sodium silicate.

It is also preferable to conduct alkali etching after the roughening for forming the aforementioned base pits.

The production of the support for a planographic printing plate of the invention can be conducted using an electrolytic bath in a radial cell type, a flat cell type, a vertical cell type or the like, and feeding may be direct feeding or indirect feeding.

An apparatus applicable to the production of the support for a planographic printing plate of the invention is illustrated in FIG. 1. The electrolytic bath 1 of the apparatus is in a radial type having a half circle bottom, and is provided with a cathode 2 in a form of are. The electrolytic bath 1 is provided with an electrolytic solution inlet port 3 at one end of the bath, and an electiolytic solution outlet port 4 at the other end. An electrolytic solution 5 is charged from the inlet port 3, and the electrolytic solution after used is discharged from the outlet 4. A drum roller 6 is provided rotatably above the cathode 2, and immersed in the electrolytic solution 5. A conveying roller 7 and a conductor roller 8 are provided above the drum roller 6 to form a traveling line of the aluminum plate 9. The conductor roller 8 and the cathode 2 are connected through a DC power source 10.

In the support for a planographic printing plate of the invention, the fine pits formed on the base pits improve fill-in characteristic and printing durability without increasing the scumming.

EXAMPLES

Example 1

A surface of a JIS 1050 aluminum plate 0.3 mm in thickness was roughened by grinding the surface using a suspension of pumice and a No. 8 nylon brush.

Subsequently, the plate was subjected to chemical etching by immersing it in 10% sodium hydroxide aqueous solution at 50° C. for 30 seconds, and then, smut (composed primarily of aluminum hydroxide) of the plate was removed by immersing in a mixed solution of 3% chromic acid and 3.5% phosphoric acid at 80° C. for 30 seconds.

Thereafter, the aluminum plate was immersed in 1% nitric acid aqueous solution containing 0.5% of aluminum ion as elerolytic solution, and was electrochemically roughened using rectangular wave alternating current having a frequency of 200 Hz at a current density of 60 A/dm$^2$ so that the quantity of electricity of the aluminum plate became 400 c/dm$^2$ upon anode, followed by washing with water.

The aluminum plate was chemically ethced in 5% sodium hydroxide aqueous solution until the dissolved amount of the aluminum plate became 0.5 g/m$^2$, and then, smut was removed by immersing in a mixed solution of 3% chromic acid and 3.5% phosphoric acid at 80° C. for 30 seconds.

Using 34% nitric acid aqueous solution at 50° C. as electrolytic solution, rendering the aluminum plate anode, electrolysis was conducted at a current density of 5 A/dm$^2$, a quantity of electricity of 15 c/dm$^2$ for 3 seconds to form fine pits.

Smut was removed by immersing in a mixed solution of 3% chromic acid and 3.5% phosphoric acid at 80° C. for 30 seconds, and subjected to anodizing in 15% sulfuric acid aqueous solution using direct current of 22 volts at a distance between electrodes of 150 mm for 60 seconds.

Example 2

A JIS 1050 aluminum plate 0.3 mm in thickness was immersed in 1% nitric acid aqueous solution containing 0.5% of aluminum ion as elerolytic solution, and was electrochemically roughened using rectangular wave alternating current having a frequency of 200 Hz at a current density of 60 A/dm$^2$ so that the quantity of electricity of the aluminum plate became 400 c/dm$^2$ upon anode, followed by washing with water.

The aluminum plate was chemically ethced in 5% sodium hydroxide aqueous solution until the dissolved amount of the aluminum plate became 0.5 g/m$^2$, and then, smut was removed by immersing in a mixed solution of 3% chromic acid and 3.5% phosphoric acid at 80° C. for 30 seconds.

Then, roughening was conducted by alternating current electrolysis in an electrolytic solution containing 12.5 g/l of hydrochloric acid having a liquid temperature of 50° C. at 120 Hz at a current density of 10 A/dm$^2$, a quantity of electricity of 15 C/dm$^2$ to form fine pits.

Smut was removed by immersing in a mixed solution of 3% chromic acid and 3.5% phosphoric acid at 80° C. for 30 seconds, and subjected to anodizing in 15% sulfuric acid aqueous solution using direct current of 22 volts at a distance between elctrodes of 150 mm for 60 seconds.

Conventional Example 1

A surface of a JIS 1050 aluminum plate 0.3 mm in thickness was roughened in the same manner as Example 1, except that the electrolysis for forming the fine pits and the subsequent smut removal were omitted.

Surface Figure

Figure 2:
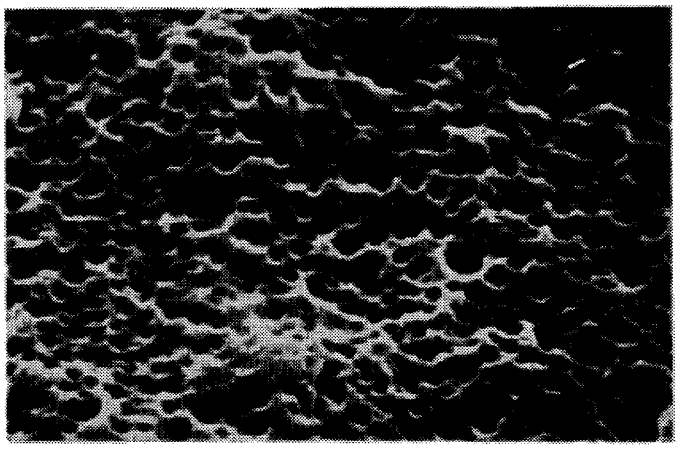
FIGS. 2 through 5 are electron microscopoe photographs of the surface of aluminum plates prepared by the method of producing a support for a planographic printing plate of the invention.
Figure 3:
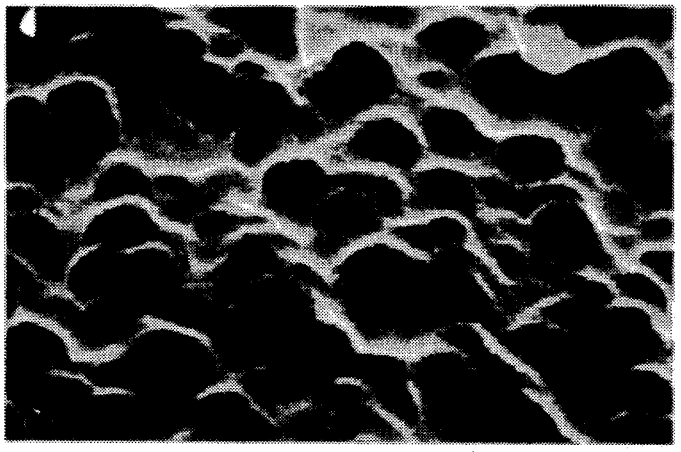
Figure 4:
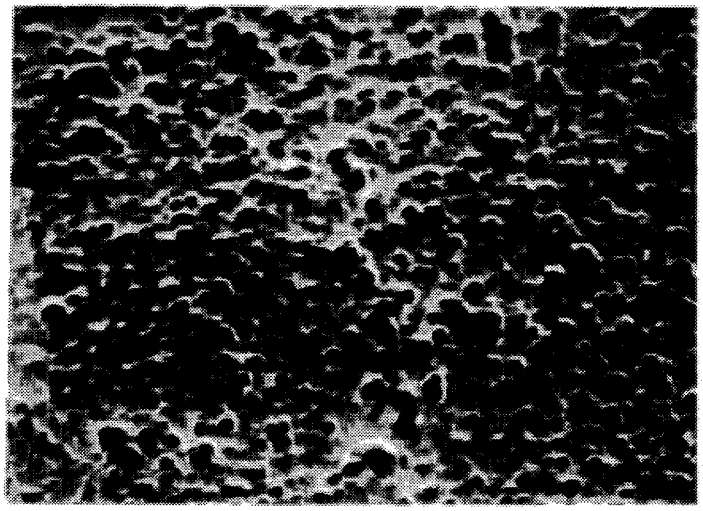
Figure 5:
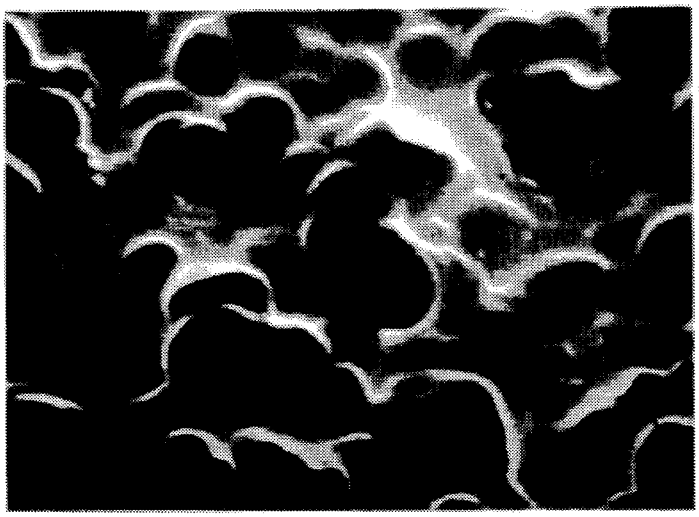

Electron microscope photographs of the aluminum plate obtained in Example 1 are shown in FIG. 2 (×10,000) and FIG. 3 (×30,000). Electron microscope photographs of the aluminum plate obtained in Example 2 are shown in FIG. 4 (×10,000) and FIG. 5 (×50,000).

By the electron microscope photographs, it was confirmed that fine pits of about 0.3 μm were formed uniformly.

Evaluation of Properties

A positive type O-diazo oxide photosensitive material was applied as a photosensitive layer in a dry thickness of 2.5 g/m$^2$ onto the above aluminum plates, and dried to produce planographic printing plates. The planographic printing plates were exposed to light, and then, developed. Each printing plate was then attached to a Heidelberg KOR printer, and printing was conducted to evaluate printing durability, scumming and fill-in under human's observational inspection.

The resluts are shown in Table 1.

TABLE 1

| | Durability Printing | Scumming | Fill-in |
|---|---|---|---|
| Example 1 | ○ | ○Δ~○ | ○ |
| Example 2 | ○ | ○Δ | ○ |
| Conventional Example 1 | ○Δ | ○Δ | Δ |

○: Excellent or Highly Reduced
Δ: Ordinary
X: Not Practical

By the above results, it was confirmed that the printing plate made of using the support of the invention is improved in printing durability and fill-in characteristic without increasing scumming.

We claim:

1. A method of producing a support for a planographic printing plate which comprises roughening a surface of an aluminum plate electrochemically, etching the surface by 0.01 to 20 g/m$^2$ with alkali, and roughening the surface electrochemically in an electrolytic solution containing at least one of a hydrochloric acid or a water-soluble hydrochloride salt which forms hydrochloride ion or at least one of a nitric acid or a water-soluble nitrate salt which forms nitrate ion as the principal component, wherein the electrolytic solution contains 15 wt % or more of nitric acid, and the second roughening is conducted by loading DC voltage to the aluminum plate rendered as an anode.

2. The method of claim 1, wherein the electrolytic solution contains hydrochloric acid and/or the hydrochloride salt, and the second roughening is conducted by loading AC voltage between the alumium plate and a counter electrode.

3. The method of claim 2, the concentration of the hydrochloric acid in the electrolytic solution is from 5 g/l to 100 g/l.

4. The method of claim 3, wherein the temperature of the electrolytic solution is from 30° C. to 55° C.

5. The method of claim 3 or claim 4, wherein the ferquency of the AC voltage is from 60 Hz to 500 Hz.

6. The method of claim 1, wherein the concentration of the nitric acid is from 30 wt. % to 40 wt. %.

7. The method of claim 6 wherein the temperature of the electrolytic solution is from 40° C. to 60° C.

8. The method of claim 6 or claim 7, wherein the quantity of electricity is from 5 $c/dm^2$ to 100 $c/dm^2$.

9. The method of claim 1, further etching the surface by 0.01 $g/m^2$ to 20 $g/m^2$ with alkali solution.

* * * * *